US006026517A

United States Patent [19]

Kang

[11] Patent Number: 6,026,517

[45] Date of Patent: Feb. 22, 2000

[54] MEN'S UNDERPANTS

[76] Inventor: James Chia-Ming Kang, 11-11 Fl., No. 49, Sec. 4, Han-Kou Road, Tai-Chung City, Taiwan

[21] Appl. No.: 09/307,068

[22] Filed: May 7, 1999

[51] Int. Cl.[7] ..... A41B 9/02

[52] U.S. Cl. ..... 2/403; 2/400

[58] Field of Search ..... 2/400–408, 78.1, 2/227, 228, 238, 79, 455–456, 466, 214, 215; 450/150

[56] References Cited

U.S. PATENT DOCUMENTS

| | | | |
|---|---|---|---|
| 3,037,503 | 6/1962 | Ravaschieri | 2/78.1 X |
| 3,207,155 | 9/1965 | Casey | 2/403 |
| 3,459,181 | 8/1969 | Mann | 2/403 |
| 3,517,666 | 6/1970 | Atlee | 2/403 |
| 5,070,869 | 12/1991 | Zhang | 2/403 X |
| 5,157,793 | 10/1992 | Michels | 2/403 |
| 5,283,912 | 2/1994 | Chung | 2/403 |
| 5,598,587 | 2/1997 | Wada | 2/403 |
| 5,718,003 | 2/1998 | Gwinn | 2/400 X |

*Primary Examiner*—Gloria M. Hale
*Attorney, Agent, or Firm*—Ezra Sutton

[57] ABSTRACT

A pair of men's underpants is provided with a pocket for receiving and covering the wearer's scrotum. The pocket prevents the scrotum from direct contact with the groin, to avoid discomfort or diseases caused by perspiration.

4 Claims, 3 Drawing Sheets

MEN'S UNDERPANTS

The present invention relates to men's underpants, more particularly to a man's underpants having a pocket for receiving the wearer's scrotum.

Underpants are intimate, personal articles for a man's body. Though naturalists advocate that men should be relieved from being entangled by such articles as clothes, especially underpants, yet underpants are still important personal articles for men.

Generally, men's underpants can be classified into two types; one is the so called rectangular type and another is the so called triangular type. These two types differ from each other only in the shape; the underpants of the rectangular type have sleeves and is designed to be loosely worn by the wearer while the underpants of the triangular type do not have sleeves and are designed to be closely fitted to the lower part of the wearer's body. Both have a long history of existing with certain changes in the shape, but without any practical change in their functional constructions. Most men do not seem to be concerned about discomfort with either type of underpants.

Actually, however, there are problems with both types of the above-mentioned underpants, as discussed below (a) Underpants of the rectangular type are designed to be loosely worn. However, conventional underpants of this type have a longitudinal central seam or sewing line extending from the upper edge of the back side and front side to the bottom of the underpants, the seam being formed while the underpants are fabricated by sewing a right hand side half and a left hand side half from the underpants material. The seam tends to rub the wearer's scrotum or groin, causing discomfort, or even skin disease. Furthermore, the conventional underpants do not provide any means for preventing the wearer's scrotum form contacting the groin; frequent contact of the scrotum with the groin create discomfort or even skin disease due to perspiration.

(b) Underpants of the triangular type are designed to be more closely fitted to the wearer's body, such that its bottom is adapted to cover the scrotum of the wearer to prevent the scrotum from rubbing against the groin. However, the underpants of this type tend to press the scrotum against the area near the wearer's anus, causing another kind of discomfort, particularly when the wearer sweats.

The present invention is designed to solve the above-mentioned problems with conventional men's underpants.

Therefore it is an object of the present invention to provide novel men's underpants which eliminate the discomfort caused to the wearer by conventional men's underpants.

It is another object of the present invention to provide novel men's underpants which prevent the wearer's scrotum from being rubbed by a part of the underpants.

It is still another object of the present invention to provide novel men's underpants which prevents the wearer's scrotum from coming into contact with the wearer's groin, and cause no pressure on the wearer's genitalia.

The above objects and the advantageous effects of the present invention can be achieved by forming a pocket on the bottom of men's underpants, the pocket being adapted to loosely receive and cover the wearer's scrotum.

The features and the advantageous effects will be readily understood from the following detailed description of the preferred embodiments with reference to the accompanying drawings.

DETAILED DESCRIPTION OF THE PREFERRED EMBODIMENTS

The men's underpants of this invention can be made in the form of rectangular type as a first embodiment and also in the form of the triangular type as a second embodiment.

Figure 1:
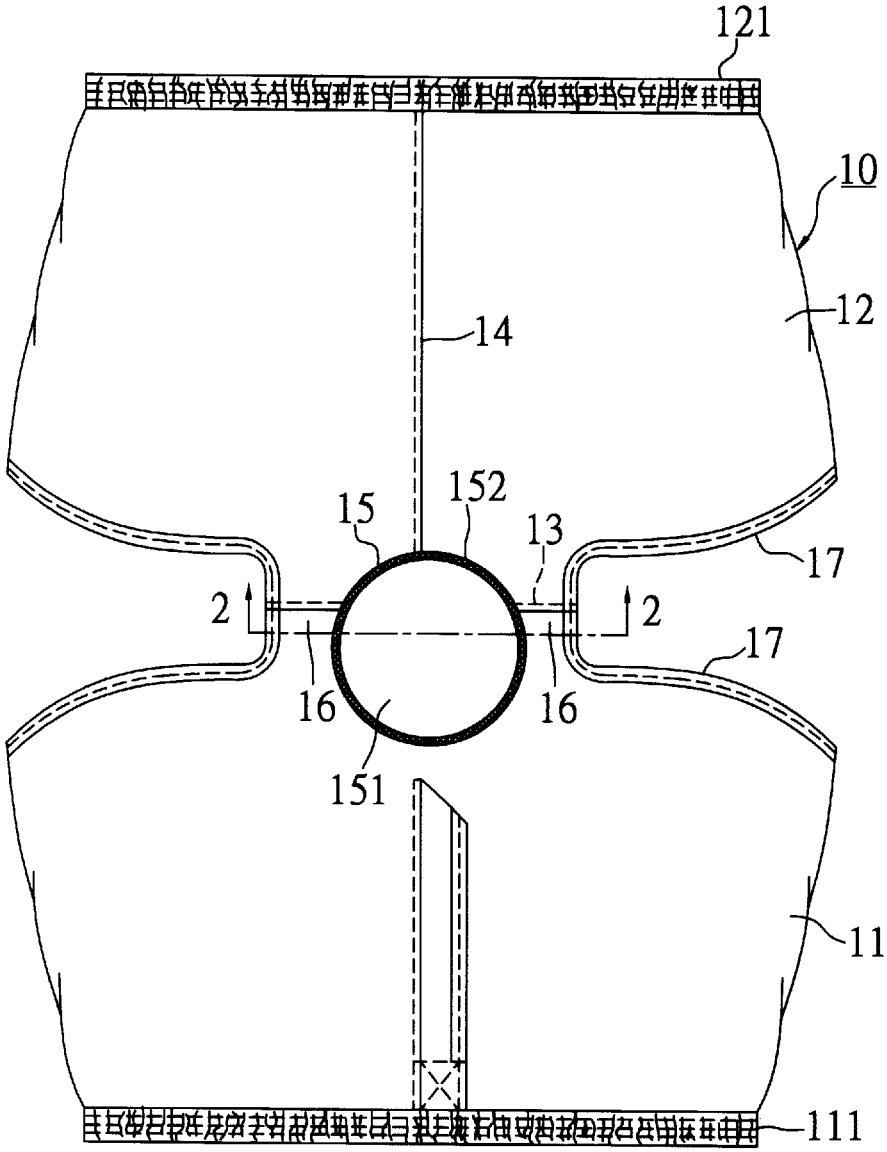
FIG. 1 is an exploded planar view of an embodiment of the men's underpants of the rectangular type of the present invention.
Figure 2:
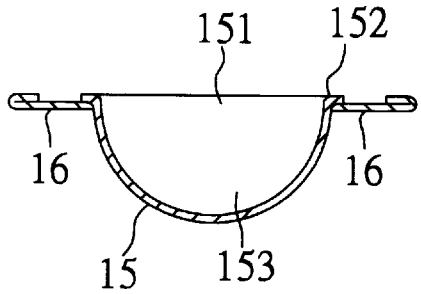
FIG. 2 is a cross-sectional view of the pocket of the men's underpants taken along the section line 2—2 of FIG. 1.
Figure 3:
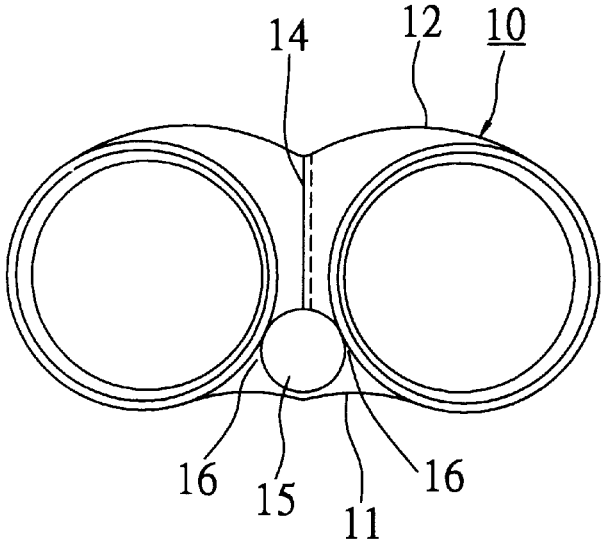
FIG. 3 is a schematic bottom view of the first embodiment of the men's underpants of the present invention.

Referring to FIG. 1, men's underpants (10) of the first embodiment comprise a front piece (11), a rear piece (12), the front piece (11) and the rear piece (12) having a stretchable strip (111) or (121) on a respective upper edge, and lower edges sewn together to form a bottom seam line (13). Each one of the front piece (11) and the rear piece has two side edges sewn with the side edges of the corresponding piece to become a complete pair of underpants. A rear, vertical sewing line (14) is formed in the rear piece (12) to extend vertically from a central part of the upper edge of rear piece (12) to the vicinity of the bottom seam line (13), where a pocket (15) adapted for receiving the wear's scrotum is provided.

The pocket (15) is prepared separately beforehand in a bowl shape having an opening (151) and a pocket edge (152) around and defining the opening (151), the pocket edge (152) being joined with the bottom parts of the first piece (11) and the second piece (12) by sewing to provide a pocket space (153), leaving an appropriate distance (16) between the pocket edge (152) and the lower edge (17) of the underpants (10).

The packet (15) may be made of such material that is the same as or different from the material for the front piece (11) and the rear piece (12); the material may be a conventional fabric.

The pocket (15) is disposed at a slightly frontward position from the bottom seam line (13) to correspond to the position of wearer's scrotum.

The rear, vertical sewing line (14) divides the area of the rear piece (12) into two symmetrical part—the right hand side area and the left hand side area, so that the rear piece (12) is adapted to cover the wearer's hip.

When worn, the pocket (15) loosely receives and covers the wearer's scrotum, avoiding direct contact between the wearer's scrotum and his groin. The bottom part of the underpants (10) defined by the distance (16) is adapted to ensure a stable coverage of the wearer's scrotum by the pocket (15).

Figure 4:
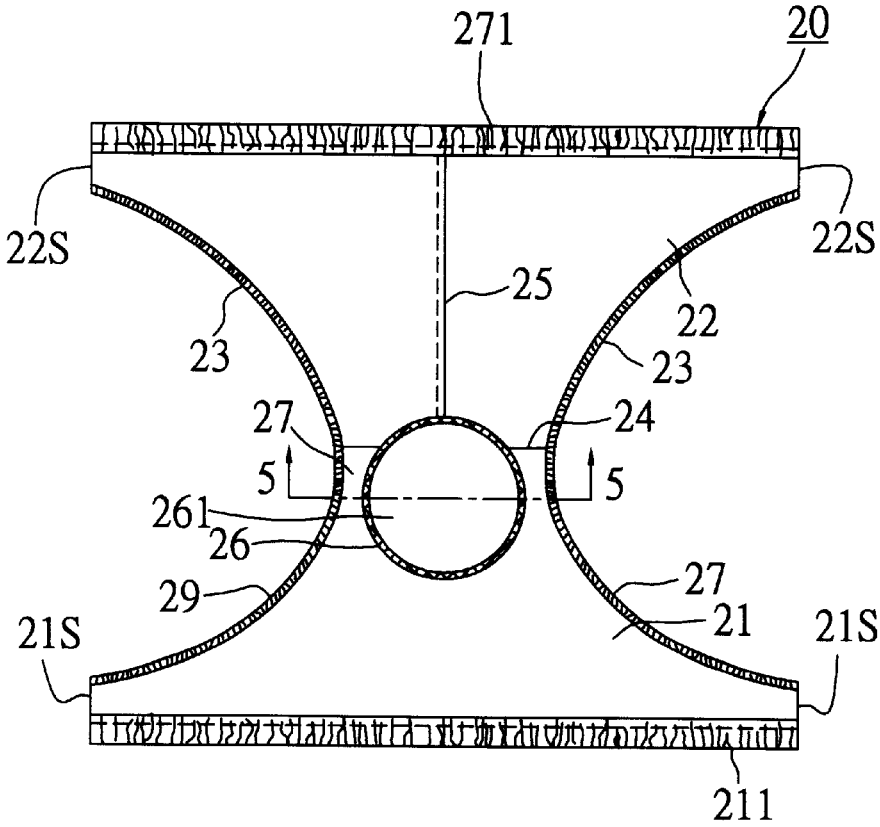
FIG. 4 is an exploded planar view of a second embodiment of the men's underpants of the present invention.
Figure 5:
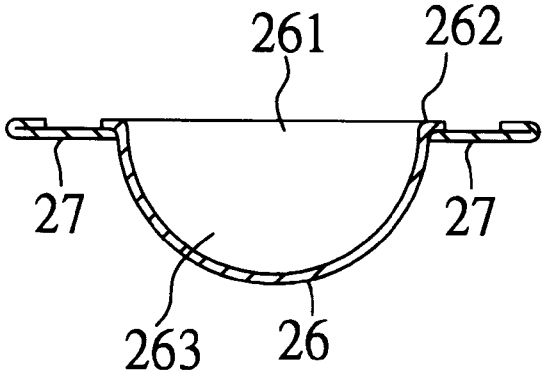
FIG. 5 is a cross-sectional view of the pocket of the men's underpants taken along the section line 5—5 of FIG. 4.
Figure 6:
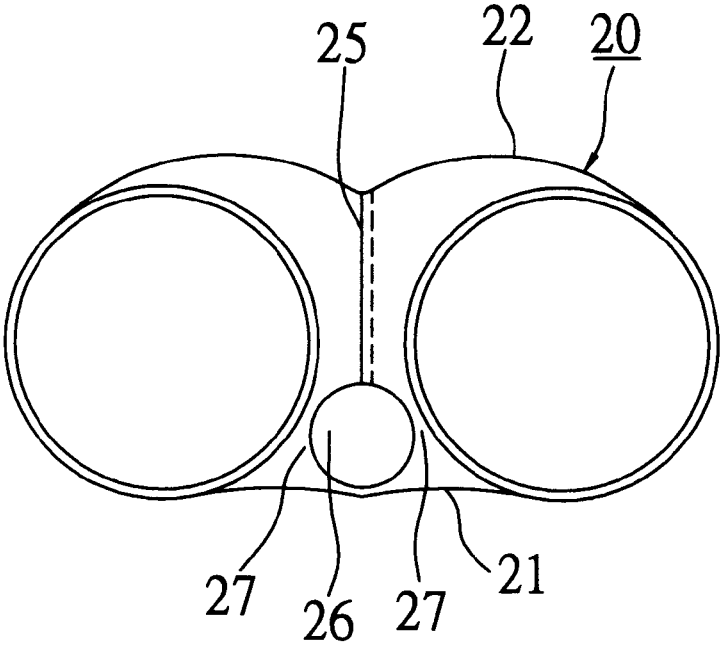
FIG. 6 is a schematic bottom view of the second embodiment of the men's underpants of the present invention.

Referring now to FIGS. 4 and 5, the men's underpants (20) of the second embodiment of this invention comprise a front piece (21) and a rear piece (22) each having an upper edge provided with a stretchable strip (211) or (221), stretchable lower edges (23) or (29), bottom edges (24) which are joined together to form a bottom seam line (24), and side edges **(21*s*) or (22*s*) which are also joined together to form a complete pair of men's underpants of the triangular type. A rear, vertical sewing line (24) is formed in the rear piece (22) to extend vertically from a central part of the upper edge of the rear piece (22) to the vicinity of the bottom seam line (23), where a pocket (26**) adapted for receiving the wearer's scrotum is provided.

Separately prepared beforehand, the pocket (26) is in a bowl shape having an opening (261) and a pocket edge (262) around and defining the opening (261), providing a pocket space (263). The pocket edge (262) is joined with the bottom parts of the front piece (21) and the rear piece (22), leaving an appropriate distance (27) between the pocket edge (262) and the lower edge (27) of the underpants (20). The remaining parts of the underpants (20) are the same as that of the men's underpants (10) of the first embodiment.

When worn, the wearer's scrotum is loosely fitted in and received by pocket (26) avoiding direct contact between the wearer's scrotum and the groin. The bottom part of the underpants (20) are defined by the distance (27) abutting the wearer's groin so as to ensure a stable coverage of the scrotum by the pocket (26).

The men's underpants of the present invention as described above renders the following advantageous effects:

(A) Pocket (15) or (26) effectively covers the wearer's scrotum with a fabric material allowing the scrotum to avoid any direct contact with any other naked part of the wearer's body, and thereby to avoid discomfort, or any skin diseases caused by rubbing between naked body parts. In this way the discomfort caused by perspiration is effectively avoided.

(B) Pocket (15) or (26) which effectively and loosely covers the wearer's scrotum also provides an adequate support for the wearer's scrotum, relieving the wearer's genitals, particularly the testicles, from suppression.

While the preferred embodiments of the men's underpants of the present invention has been described above, it should be understood that the embodiments were illustrated by way of example, which are not meant to limit the invention. Modifications are possible within the scope and spirit defined in the appended claims.

What is claimed is:

1. Men's underpants, comprising a front piece made of a fabric and having a bottom edge, a rear piece made of a fabric and having a bottom edge joined with said bottom edge of said front pieces to form a bottom sewing line, a pocket having a pocket opening through said bottom sewing line and a pocket space adapted to receive the wearer's scrotum.

2. Men's underpants of claim 1, wherein said pocket is made of the same fabric as said fabric of said front piece.

3. Men's underpants of claim 1, wherein said pocket is made of a fabric that is different from said fabric of said front piece.

4. Men's underpants of claim 1, wherein said rear piece has a sewing line extending vertically downward from a central point of an upper edge of said rear piece.

* * * * *